United States Patent [19]

Hicks

[11] 4,009,548

[45] Mar. 1, 1977

[54] ROOF CONSTRUCTION

[75] Inventor: Clarence R. Hicks, Greeneville, Tenn.

[73] Assignee: Ball Corporation, Muncie, Ind.

[22] Filed: Sept. 30, 1975

[21] Appl. No.: 618,120

[52] U.S. Cl. ..... 52/469; 52/466; 52/479

[51] Int. Cl.[2] ..... E04C 1/34; F16B 1/00

[58] Field of Search ..... 52/466, 467, 469, 479, 52/497, 498, 584, 586, 618

[56] References Cited

UNITED STATES PATENTS

| | | | |
|---|---|---|---|
| 1,723,166 | 8/1929 | Hayman | 52/760 |
| 1,820,700 | 8/1931 | Hatch | 52/466 |
| 2,417,899 | 3/1947 | Ashman | 52/549 |
| 2,704,687 | 3/1955 | Adell | 52/469 |
| 3,209,503 | 10/1965 | Mostoller | 52/478 |
| 3,323,269 | 6/1967 | Widdowson | 52/547 |
| 3,335,530 | 8/1967 | Hurd | 52/497 |
| 3,388,518 | 6/1968 | Scott | 52/547 |
| 3,641,729 | 2/1972 | Irvin | 52/588 |

FOREIGN PATENTS OR APPLICATIONS

| | | | |
|---|---|---|---|
| 663,390 | 12/1951 | United Kingdom | 52/469 |

*Primary Examiner*—Ernest R. Purser
*Assistant Examiner*—Robert C. Farber
*Attorney, Agent, or Firm*—Donald R. Cassady

[57] ABSTRACT

A metal covering for a roof deck which comprises: a spaced parallel array of corrugated pan supports, fastened to the deck; standoff support strips placed substantially centered therebetween and fastened to the deck, said standoff strips consisting of a base, a vertical member and a horizontal member spaced above the base; roof pans which lay on the corrugated pan supports and the horizontal member of the standoff supports in abutting relationship to the vertical member of the standoff support strip, abutting portions of the said roof pans consisting of an upturned edge on one side and an upturned edge with a downturned flange on the opposite side; the downturned flange being placed over the vertical member of the standoff support and the abutting upturned edge of the adjoining roof pan; the seam consisting of three pieces, the upturned edge of the roof pan, the vertical member of the standoff support, and the upturned edge of the adjacent roof pan, being dimple punched on alternating sides along the length of the seam; and a two-piece cap forced over the dimple punched seam, said cap comprising an inverted V-shaped portion with inwardly inverted sides and an insert placed therewithin, substantially adjoining all of the inner surfaces of the cap.

2 Claims, 3 Drawing Figures

ROOF CONSTRUCTION

BACKGROUND OF THE INVENTION

Many methods have been used and still others proposed for covering wooden roof decks by metal sheets, pans, or the like. For example, it is well known to use sheet metal overlaid in a manner similar to the overlaying of wooden or asphalt shingles, nailing the individual sheets under the overlap of the adjacent sheets to lessen water leakage and rusting. Roofs of this type are especially vulnerable to high winds which cause curling of the sheets, exposing the nails to rust and leakage.

To overcome these pitfalls, metal sheeting with various interlocking joint constructions have been proposed. These interlocking constructions include forming adjacent upstanding portions on the edges of sheet metal pans and covering these adjacent upstanding portions with clips or the like to prevent leakage. However, leakage will continue to occur in many of these constructions by capillary action between the closely spaced surfaces of the upstanding portions. This leakage is promoted by the freezing and thawing of the air, water, and water vapor trapped between the layers.

A further defect in the prior art roof coverings has been the use of clips which, when forced over upturned pan edges or flanges or upturned flanges and pins, will cause the pin and pan edges to crush, providing excellent gaps for leakage. Still further defects include improperly formed clips; the expansion and contraction of these clips or like covering devices loosens the clip which then becomes vulnerable to the wind. The present invention overcomes these defects.

SUMMARY OF THE INVENTION

This invention provides a water tight roof construction for connecting roof pans over a wooden or similarly vulnerable roof deck.

This invention further provides a water tight roof construction for connecting roof panels which are spaced above the roof deck to provide ventilation therebetween.

The construction herein provided obviates all of the disadvantages hereinbefore disclosed. Further advantages will become obvious to those skilled in the art by a further reading of this description of the invention.

The present construction involves fastening corrugated pan supports in spaced parallel array on the roof deck; fastening standoff support strips on the roof deck between the corrugated pan supports; then placing roof pans substantially centered over the corrugated pan supports in such a manner that adjoining pans abut the sides of the standoff support strips and lock thereupon. Such locking is provided in the following manner. Each pan is provided with an upturned flange on one side and an upturned flange with a downturned rolled edge on the opposite side. When the pans are in abutting relationship, supported by the corrugated pan supports, the rolled edge of the one upturned flange covers the adjoining upturned flange and standoff support, thereby locking the three pieces in a sandwich arrangement. The standoff support strip extends vertically to a height equivalent to the total height of the pan support and upturned flange of the adjoining roof pan as it rests upon the pan support. A horizontal member of the standoff support strip is so formed that a portion underlies the edge of the roof pan containing the upturned flange which rests firmly on such horizontal member to give stability to the roof pan prior to fastening. This horizontal member is fabricated by multiple thickness layers or by appropriate rolling or bending of the support. The height of this horizontal member shall be similar to the height of the pan support, thus the pan support, horizontal member, and rolled edge of the roof pan combine to provide substantially uniform height support for the roof pans.

After arranging the pan supports, standoff support strips and roof pans, the sandwich comprising the upturned flange, the standoff support strip and the upturned flange containing the downturned rolled edge are locked in lateral position by dimple punching through all of the above identified members on alternating sides along the length of the upstanding sandwich. An inverted V-shaped cap with inwardly inverted sides and a stiffening insert placed therewithin, substantially adjoining all of the inner surfaces of the cap, is forced over the formed dimple punched seam until the inwardly inverted edge locks firmly over the formed dimples.

The component pieces of the roof construction of this invention can be made of any metal which is durable under the conditions to which it will be subjected. It will be recognized that certain metals and combination of metals will not be appropriate for such construction because of galvanic currents which can be set up due to salts and acids which leech from the wooden underlay. Of particular value is the construction where the corrugated pan support and cap stiffening inserts are made of galvanized iron and all other components are made of zinc.

DETAILED DESCRIPTION OF THE DRAWINGS

In order to more clearly disclose the construction, operation, and use of the invention, reference should be made to the accompanying drawings forming part of the invention. Throughout the several views in the drawings, like reference characters designate the same parts.

Figure 3:
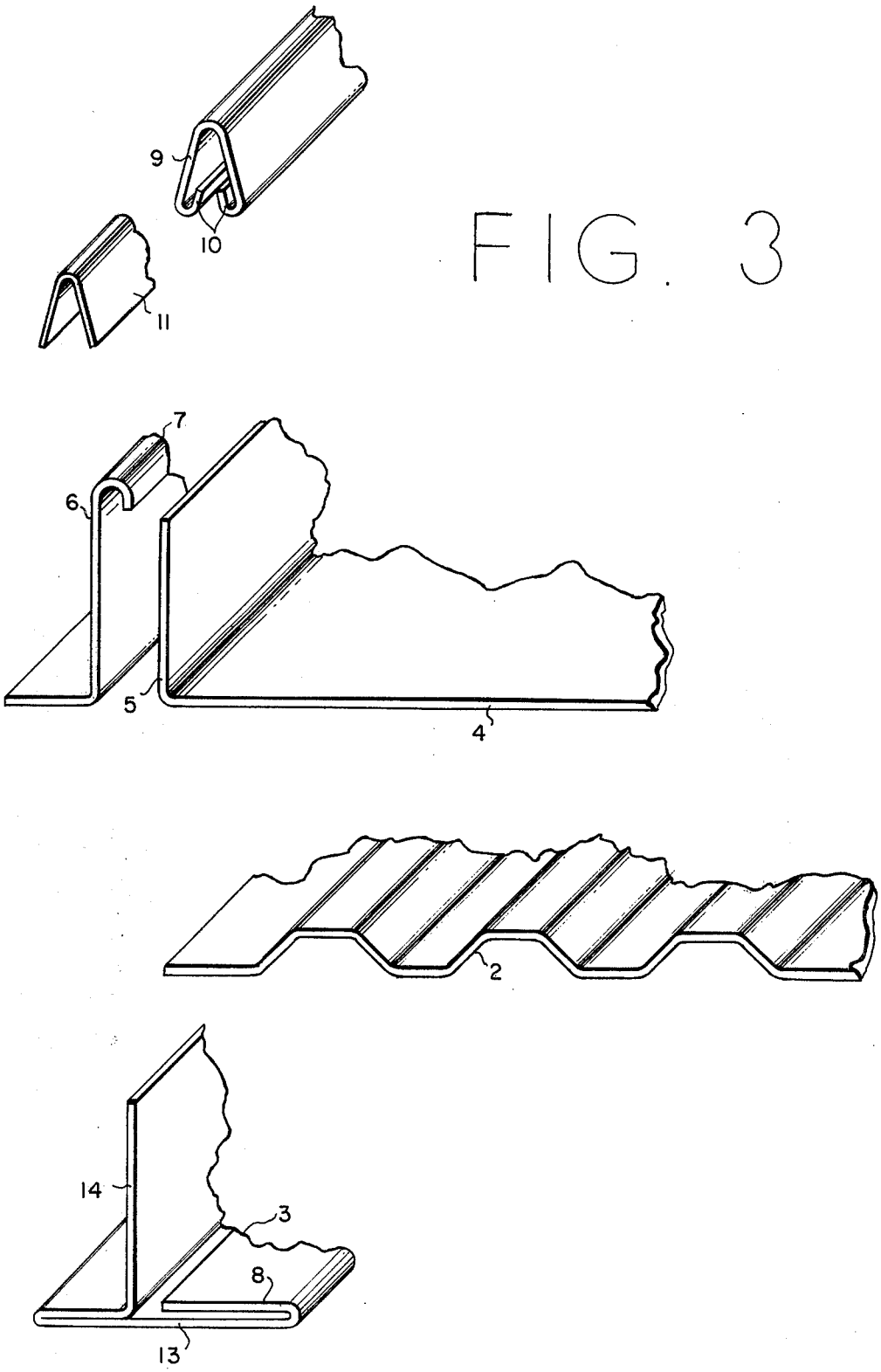
FIG. 3 is a diagrammatic view, partly broken away, of each of the components of the present roof construction shown before assembly.

In FIG. 3, the lower most drawing depicts the standoff support 3 comprising a base portion 13, an upstanding portion 14, and a horizontal member 8 upon which the edge of the roof pan 4 rests.

The lower middle drawing depicts the corrugated roof support 2 which is fastened in parallel spaced array on the deck as a support for the roof pans 4 and to provide dead air space for insulation capacity between the deck and the roof pans.

The upper middle drawing depicts opposing sides of two different roof pans 4, so placed to demonstrate the difference therebetween: one side with an upturned flange 5 and the opposing side with the upturned flange 6 containing a downturned edge 7.

The upper most drawing is of the cap 9, and 11 the stiffener which fits therein. The V-shaped cap 9 possesses inwardly inverted edges 10 to snap lock over the dimple punched sandwich consisting of pieces 5, 6, and 14.

Figure 2:
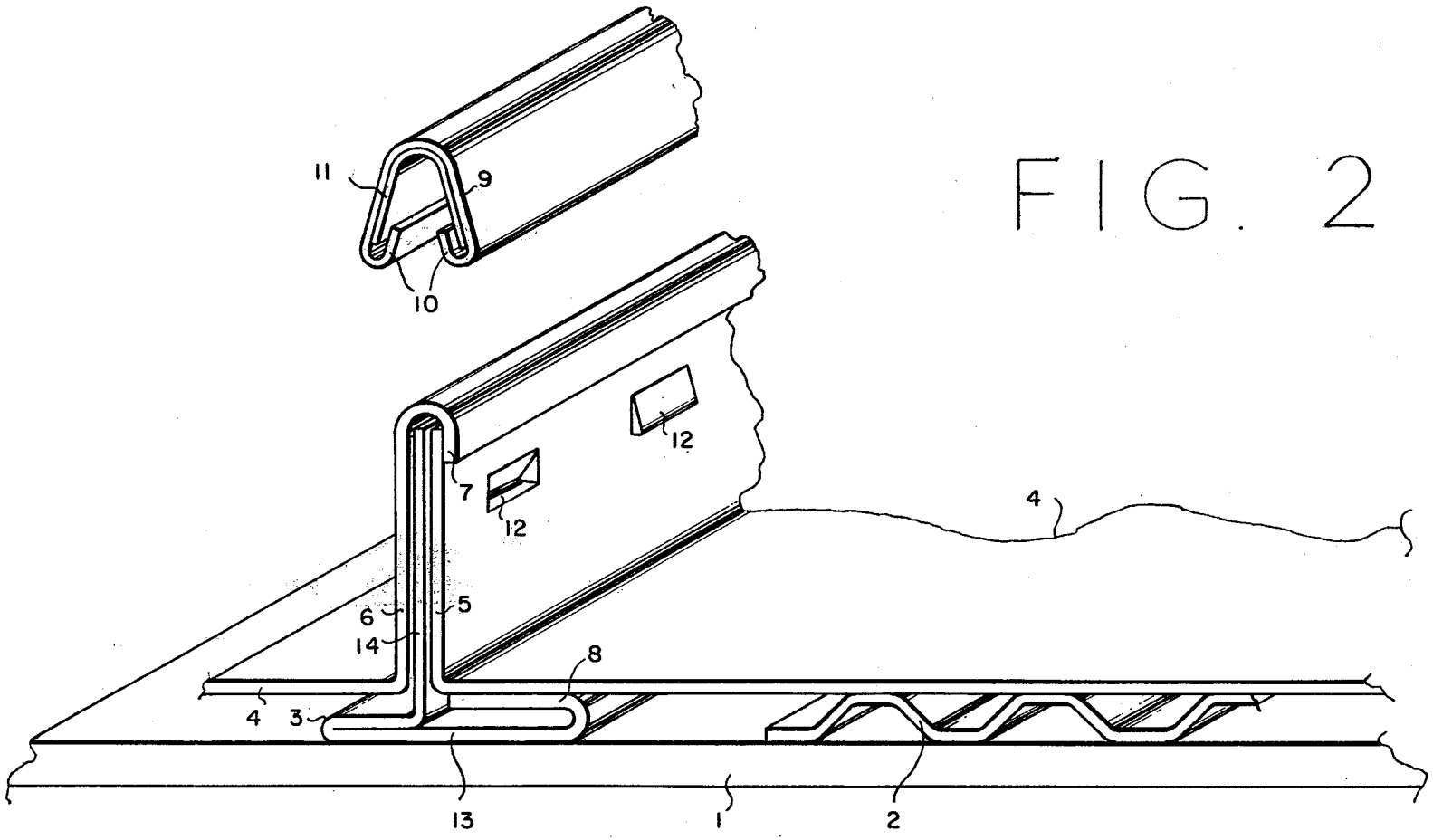
FIG. 2 is a diagrammatic view, partially broken away, of an incompleted roof construction of this invention shown after dimple punching and prior to covering the upstanding sandwich portion of the construction with the bi-component cap.

FIG. 2 depicts a partially completed seam, the corrugated roof pan support 2 is shown fastened in position over the deck 1, the base 13 of the standoff support is fastened to the deck 1 with the upstanding portion 14 in position to be abutting the flange 5 and 6 of adjacent roof pans 4 with the downturned edge of the flange 6 locked over the upstanding portion of the standoff support 3 and the flange 5 of the adjacent roof pan. The three upright members have been dimple punched at 12 on alternate sides. The cap stiffener 11 has been inserted into the cap 9 and the assembly readied for closure of the locked joint.

Figure 1:
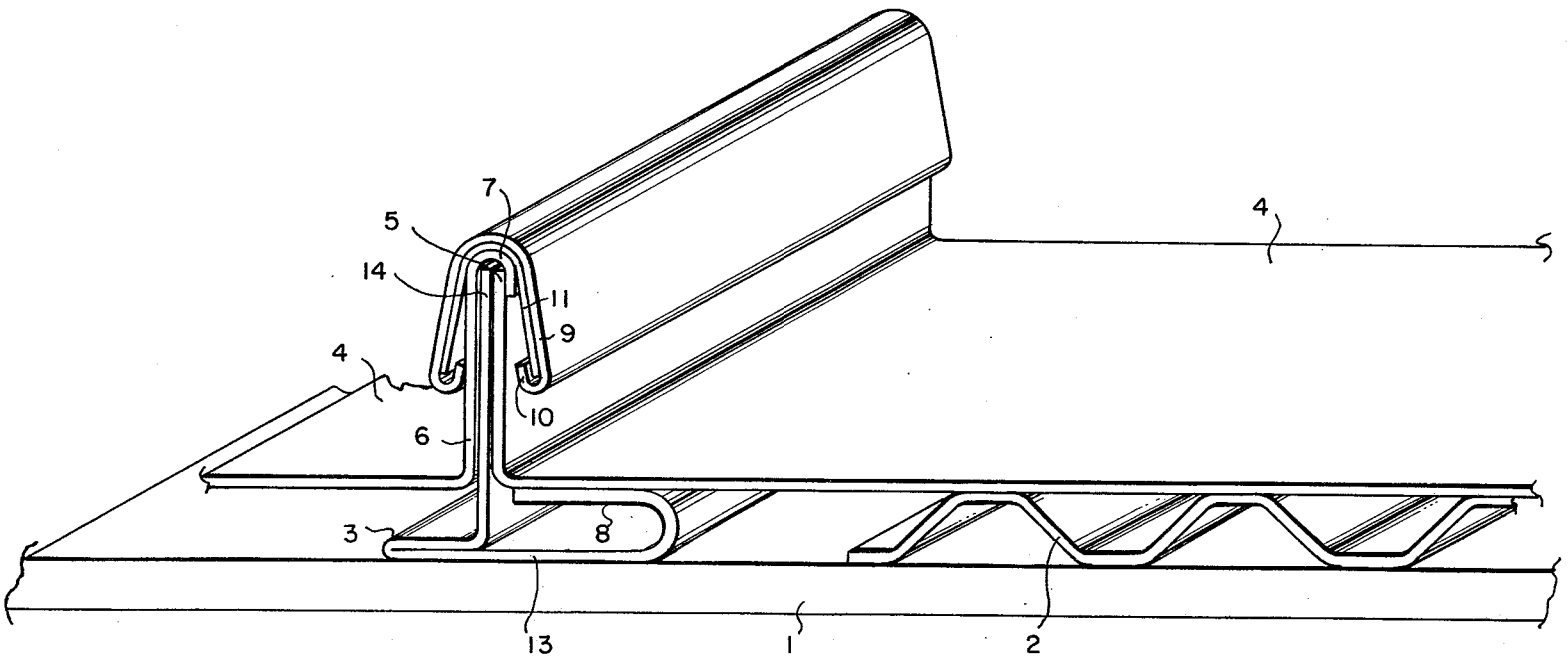
FIG. 1 is a diagrammatic view, partially broken away, of the completed roof construction of this invention.

In FIG. 1, the two piece cap assembly has been affixed to the joint and the joint is completed.

According to the method embodiment of the invention, a series of corrugated metal plates, pan supports, 2 are placed in spaced parallel array on the deck 1. The standoff support strip 3 is centered between the corrugated plates at an appropriate distance therebetween in such manner that the vertical member firmly abuts the upturned edges of the subsequently laid roof pans. The corrugated pans supports 2 and standoff supports 3 are firmly anchored to the deck with nails, screws, or adhesive materials.

Roof pans 4 are then laid on the corrugated pan supports 2 abutting the standoff support 3 in such a manner that the downturned edge 7 of the upturned flange 6 of each roof pan locks over the upturned flange 5 of the adjacent roof pan and the standoff support 3. It will be noted that the horizontal member 8 of the standoff support 3 provides lateral support for the roof pan 4 on the side of the pan which contains the upturned flange 5 but not the upturned flange 6 with the downturned edge 7.

The combination of the standoff support 3 and the roof pan flanges are then locked by dimple punching 12 on alternate sides of the sandwich throughout the length of the seam, and the completed seam is covered by V-shaped cap 9 with inwardly inverted flanges 10 and stiffening insert 11.

It is believed that the construction, operation, and use of the present invention is clear from the description and accompanying drawings. Many changes can obviously be made in the construction, arrangement, and disposition of the various parts of the invention and still be within the scope of the appended claims which define the invention in its entirety; the drawings and description being limited to the preferred embodiment.

I claim:

1. A metal covering for a roof deck which comprises:

a. a spaced parallel array of corrugated pan supports, fastened to the deck;

b. standoff support strips placed substantially centered therebetween and fastened to the deck, said standoff strips consisting of a base, a vertical member and a horizontal member spaced above the base;

c. roof pans which lay on the corrugated pan supports and the horizontal member of the standoff supports in abutting relationship to the vertical member of the standoff support strip, abutting portions of the said roof pans consisting of an upturned edge on one side and an upturned edge with a downturned flange on the opposite side; the downturned flange being placed over the vertical member of the standoff support and the abutting upturned edge of the adjoining roof pan;

d. the seam consisting of three pieces, the upturned edge of a roof pan, the vertical member of the standoff support, and the upturned edge of the adjacent roof pan, being dimple punched on alternating sides along the length of the seam; and e. a two-piece cap forced over the dimple punched seam, said cap comprising an inverted V-shaped portion with inwardly inverted sides and an insert place therewithin, substantially adjoining all of the inner surface of the cap.

2. A method for covering a roof deck which comprises:

a. fastening a spaced parallel array of corrugated pan supports to the deck;

b. fastening to the deck standoff support strips substantially centered therebetween, said standoff strips consisting of a base, a vertical member and a horizontal member spaced above the base;

c. laying roof pans on the corrugated pan supports and the horizontal member of the standoff supports in abutting relationship to the vertical member of the standoff support strip, abuting portions of the said roof pans consisting of an upturned edge on one side and an upturned edge with a downturned flange on the opposite side; the downturned flange being placed over the vertical member of the standoff support and the abutting upturned edge of the adjoining roof pan;

d. dimple punching the seam consisting of three pieces, the upturned edge of a roof pan, the vertical member of the standoff support, and the upturned edge of the adjacent roof pan on alternating sides along the length of the seam; and e. forcing a two-piece cap over the dimple punched seam, said cap comprising an inverted V-shaped portion with inwardly inverted sides and an insert placed therewithin, substantially adjoining all of the inner surfaces of the cap.

* * * * *